US005259829A

United States Patent [19]

VanEgmond

[11] Patent Number: 5,259,829

[45] Date of Patent: Nov. 9, 1993

[54] CENTRIFUGAL SEPARATING APPARATUS

[76] Inventor: Cornelis F. H. VanEgmond, H.C. 2, Box 270A, Canyon Lake, Tex. 78133

[21] Appl. No.: 2,721

[22] Filed: Jan. 11, 1993

[51] Int. Cl.[5] ..... B04B 7/04

[52] U.S. Cl. ..... 494/60; 494/56; 494/901

[58] Field of Search ..... 494/60, 61, 63, 27, 494/25, 26, 28, 22, 23, 56, 30, 31, 32, 900, 901

[56] References Cited

U.S. PATENT DOCUMENTS 4,059,364 11/1977 Anderson ..... 494/60
4,267,964 5/1981 Williams ..... 494/60
4,353,499 10/1982 Simonds ..... 494/60
4,512,759 4/1985 Alink ..... 494/60

*Primary Examiner*—Robert W. Jenkins
*Attorney, Agent, or Firm*—Bill B. Berryhill

[57] ABSTRACT

Apparatus for separating oil and water from a stream of fluid may include a stationary housing in which is centrally disposed for rotation therein a chamber assembly including an upper and lower chamber. A plurality of U-tube assemblies extend radially outward of the chamber assembly providing a plurality of U-tube paths which are inclined downwardly from the chamber assembly. A power device rotates the chamber assembly and the U-tube assemblies subjecting the stream of fluid to centrifugal forces and separating oil and water into the upper and lower chambers, respectively, for exit therefrom.

20 Claims, 3 Drawing Sheets

CENTRIFUGAL SEPARATING APPARATUS

BACKGROUND OF THE INVENTION

1. Field of the Invention

The present invention pertains to fluid separating apparatus. More specifically, the present invention pertains to apparatus suitable for separating gas, oil and water from a stream of fluid whose components include gas, oil and water.

2. Description of the Prior Art

Many oil wells, in addition to oil, produce water and gas. For many years, the fluids produced from a well having water have been passed through dewatering tanks to separate the gas, oil and water therein. Such tanks are typically provided with baffles and compartments through which the well effluent is passed. An upper gas space and outlet are provided in the top of the tank. Oil with a typical density of 0.75 to 0.85 being lighter than water with a density of 1.0, is expected to rise to the top of the effluent and be drawn off from a compartment to which the upper part of the effluent is permitted to pass. The denser water is drawn off from the bottom of the tank.

As can be understood, such means of separation depends almost entirely on gravity separation. For gravity separation to be effective, there must be sufficient time of residence in the dewatering tank. Thus, the ability to separate oil and water depends greatly on the size of the dewatering tank and the volume of flow therethrough. Obviously, a small tank is very limited in flow volume. A very large dewatering tank or several dewatering tanks may be required for large flow volumes.

In recent years, efforts have been made to develop oil and water separation equipment which does not require the large tanks and long residence times common to tank and skimmer type gravity equipment. Such systems appear to be directed toward oil and gas separation by mechanisms other than static gravity flow. In one system, for example, oil and water separation is accomplished utilizing hydrocyclones which produce enhanced centripetal forces to separate the oil and water.

Equipment for separating gas, oil and water from hydrocarbon wells of increased capacity and efficiency are very much desired by the industry. In addition, equipment capable of separating oil and water from an oil spill at sea, lake, harbor or water body is much desired. Equipment which would be capable of both of these functions would be especially desirable.

SUMMARY OF THE PRESENT INVENTION

In the present invention, apparatus is disclosed in which centrifugal force is utilized to enhance gravity separation of oil and water. The apparatus includes an enclosed housing which has an upper inlet through which a stream of gas, oil and water effluent may enter. Centrally disposed in the housing for rotation about a central vertical axis is a rotatable chamber assembly. The chamber assembly includes upper and lower cylindrical chambers, the upper chamber being in fluid communication with the incoming fluid stream and both chambers having outlet ports in the outer walls thereof. Some type of power device is connected to the chamber assembly for rotation thereof.

Extending radially and outward from the chamber assembly is a plurality of U-tube assemblies having upper legs of which extend radially outward and are inclined downwardly from the upper chamber and lower legs of which extend radially outward and are inclined downwardly from the lower chamber. The radially outer ends of the upper and lower legs communicate with each other through tubular return sections.

In operation, the power device is activated, causing the chamber assembly and the U-tube assemblies attached thereto to rotate at a predetermined speed about a central vertical axis. The effluent entering the first chamber is subjected to centrifugal forces which in combination with gravitational forces cause oil and water therein to separate, the water passing through the upper legs, return sections and lower legs of the U-tube assemblies into the lower chamber for exit through the lower chamber outlet port. Oil accumulating in the upper legs of the U-tube assemblies and the upper chamber exits through the upper chamber outlet ports. If any gases are in the effluent, the gases exit through an opening in the top of the upper chamber.

In a preferred embodiment, outer and inner concentrically disposed collection chambers are carried by the housing for collecting oil and water, respectively, discharged from the upper and lower chamber outlets, respectively. Oil overflow tubes are connected to the upper and lower chamber outlet ports, the free ends of which extend into the outer and inner collection chambers respectively. Thus oil and water exiting through the outlet ports of the upper and lower chambers, respectively, is collected in the outer and inner collection chambers for eventual removal through oil and water outlets.

With the centrifugally enhanced gravity separation provided by the separating apparatus of the present invention, the capacity and efficiency for oil and water separation is greatly increased over prior art dewatering tank technology. A single separator, constructed according to the present invention, could be used for several wells. In addition, the oil and water separation apparatus of the present invention would be highly effective in separating and collecting oil from oil spills in bodies of water. While the separating apparatus of the present invention is more complex and expensive to manufacture and operate than the relatively static dewatering tank apparatus of the prior art, it is still relatively simple in manufacture and operation. Furthermore, its greatly increased capacity and efficiency much more offsets the additional cost of construction and operation. Many other objects and advantages of the invention would be apparent from reading the description which follows in conjunction with the accompanying drawings.

DESCRIPTION OF A PREFERRED EMBODIMENT

Figure 1:
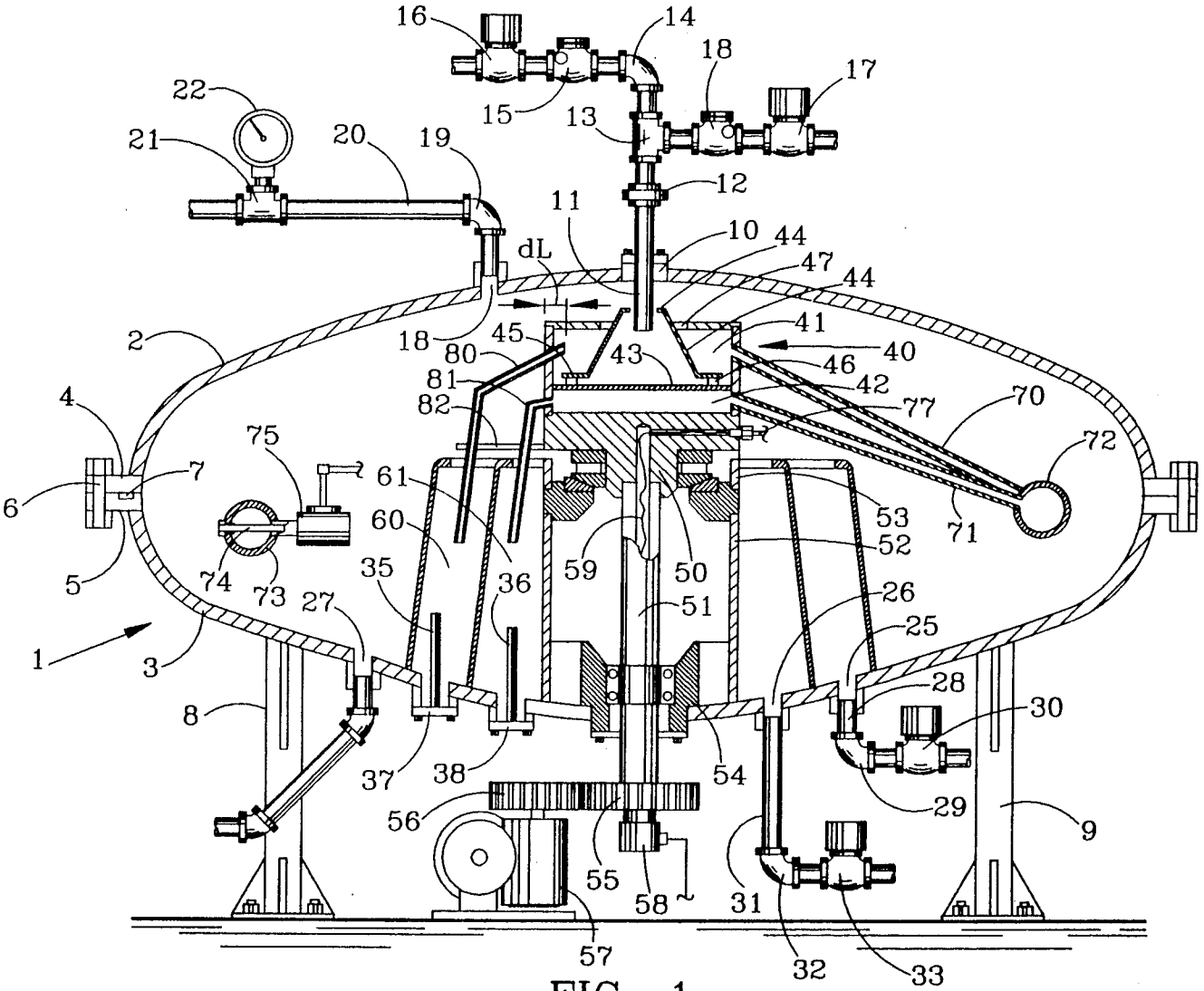
FIG. 1 is an elevation view, partially in section, of gas, oil and water separation apparatus, according to a preferred embodiment of the invention.
Figure 1A:
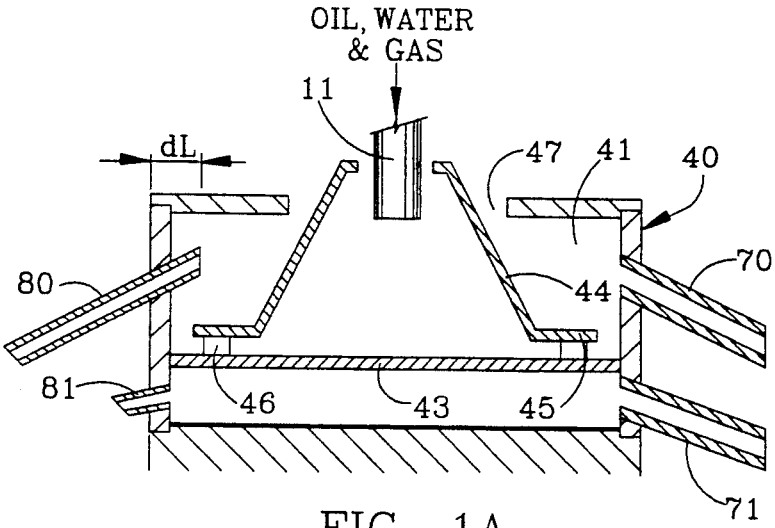
FIG. 1A is an enlarged detailed elevation view, in section, of an upper central portion of the gas, oil and water separation apparatus of FIG. 1.
Figure 2:
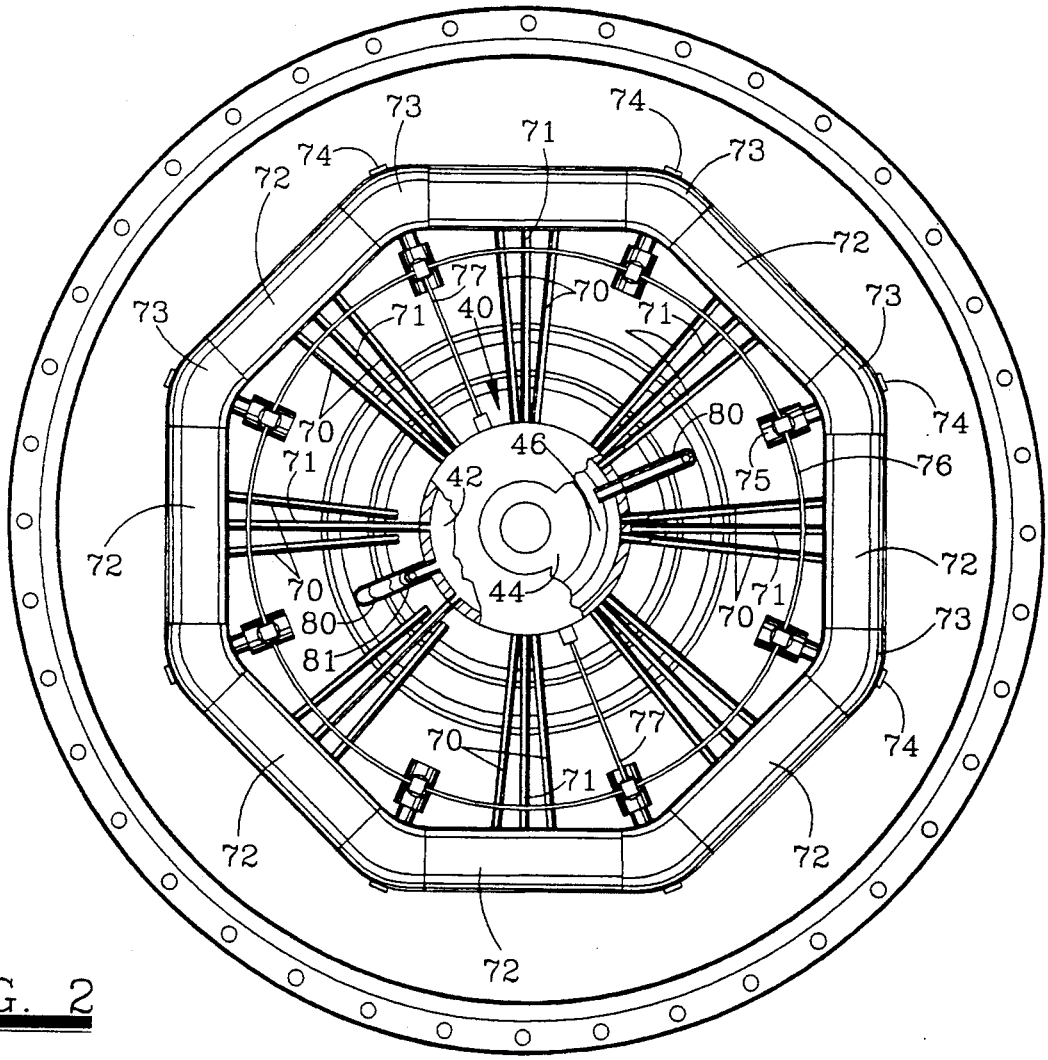
FIG. 2 is a plan view of the gas, oil and water separation apparatus of FIG. 1, with an upper part of the housing removed and portions of the apparatus being shown in section.

Referring first to FIGS. 1, 1A and 2 of the drawings, there is shown separating apparatus for separating gas, oil and water, according to a preferred embodiment of the invention. The apparatus comprises an enclosed housing 1 which in the preferred embodiment is constructed of upper and lower heads 2 and 3 similar to the heads of a cylindrical tank. Each of the heads 2, 3 is provided with a flange 4, 5 with holes for receiving bolts 6 which in cooperation with an annular seal 7 hermetically seals the interior of the housing 1. The housing 1 may be supported on support legs 8 and 9.

The housing 1 is provided with an inlet 10 through which an inlet tube 11 downwardly projects. The inlet tube 11 is connected by pipe coupling 12, a pipe tee 13, elbow 14, check valve 15 and a solenoid operated valve 16 to the output of an oil or oil and gas well or wells. Typically the effluent from such wells include oil, water, gas and sediment. It will also be noted that an auxiliary supply of water may be connected to the pipe tee 13 through another solenoid valve 17 and check valve 18. The upper portion of the housing 1 is also provided with a gas outlet 18 through which gas may flow from the housing 1 through piping elements 19, 20, 21 through gas meters or other gas processing equipment. A pressure gauge is represented at 22.

The bottom of the housing 1 may be provided with several outlets, an oil outlet 25, a water outlet 26 and a sediment outlet 27. The oil outlet 25 is connected by various piping elements 28, 29 to a solenoid operated valve 30. The water outlet 26 is connected by various piping elements 31, 32 to a solenoid operated valve 33. The solenoid operator of the oil valve 30 is connected to a liquid level sensor 35 and the solenoid operated water valve 33 is connected to a liquid level sensor 36 both of which project upwardly through fittings 37 and 38 provided in the bottom of the housing 1. The cooperation of these components will be more fully understood hereafter.

Centrally disposed in the housing 1 for rotation therein is a chamber assembly 40. The chamber assembly 40 includes an upper cylindrical chamber 41 and a lower cylindrical chamber 42 separated by a circular wall 43. The upper chamber 41 has an upper central opening 47 and is provided with a frusto-conical flow direction device 44, the smaller diameter end of which opens upwardly into the housing 1. The larger diameter end of the flow direction device 44 is provided with a flared or flanged edge 45 which is affixed to a plurality of angular spaced supports 46, slightly elevating the device above the bottom of the upper chamber 41 to provide radial paths though which any oil and water entering the chamber assembly through the inlet tube 11 must pass prior to exit from the upper chamber 41.

The chamber assembly 40 includes a central hub or base 50 which is affixed to a shaft 51, the lower end of which projects through a central opening in the lower end of the housing 1. The hub 50 and shaft 51 are rotatingly supported in a bearing housing 52 by an upper bearing assembly 53 and a lower bearing assembly 54, both of which are gas tight. The lower end of the shaft 51 is connected by properly selected gears 55 and 56 to a power device such as an electric motor 57. The lower end of the shaft 51 may also be provided with an electrical slip ring device 58 by which electricity may be supplied through electrical wiring 59 disposed in a central longitudinal passage through the shaft 51 to electrically operated valves to be described hereafter. Obviously, operation of the motor 57 and rotation of the shaft 51 thereby causes rotation of the chamber assembly 40 and tubular members (described hereafter) attached thereto.

Surrounding the bearing housing 52 in the lower portion of the housing 1 are concentrically disposed collection chambers 60 and 61. Both of these collection chambers 60, 61 are open at the tops thereof. The outer chamber 60 is an oil collection chamber which communicates with the oil outlet 25 and into which the oil level sensor 35 extends. The inner chamber 36 is a water collection chamber which communicates with the water outlet 26 and into which the water level sensor 36 extends.

Extending radially outward from the chamber assembly 40 is a plurality of U-tube assemblies each one of which, as shown in FIG. 1, provides U-tube paths having upper legs 70 which extend radially outward and are inclined downwardly from the upper chamber 41 and lower legs of which extend radially outward and are inclined downwardly from the lower chamber 42. As best seen in FIG. 2, each of the sets of U-tube assemblies, eight sets being shown in FIG. 2, includes a pair of upper legs 70 and a single lower leg 71, the radially outer ends of which communicate through tubular return sections 72. As viewed from above, as in FIG. 2, these components are similar to a wheel, the chamber assembly 40 representing the hub, the U-tube leg 70 and 71 the spokes and the tubular return section 72 the rim of the wheel.

As further illustrated in FIG. 2, the tubular return section 72 are connected to tubular bends 73 in each one of which is provided a solenoid operated sediment valve 74 operated by a solenoid 75. (See also in FIG. 1.) Electricity is provided to the solenoid 75 through a conduit ring 76 and radial conduits 77 through which the wiring 59 from the longitudinal passage of shaft 51 (see FIG. 1) passes.

From viewing the drawings of FIG. 1 and 2, it is obvious that the inward ends of the upper, more inclined U-tube legs 70 communicate with the upper chamber 41 and that the inward ends of the less inclined lower U-tube legs 71 communicate with the lower chamber 42. Thus, the upper and lower chambers 41 and 42 communicate with each other through the U-tube paths provided by the U-tube legs 70, 71 and the interconnecting U-tube return sections 72.

Also projecting radially outward from the chamber assembly 40 is at least one pair of overflow tubes which includes an oil overflow tube 80 and a water overflow tube 81. There are two pairs of these tubes 80, 81 shown in FIG. 2. The lower water overflow tube 81 is connected to an outlet port in the walls of the lower chamber 42. The upper oil overflow tube 80 projects through an outlet port provided in the wall of the upper chamber 41 for a small distance which in FIG. 1 and 1A is designated as dL. The purpose of this slight projection (dL) will be more fully understood hereafter. The oil overflow tube 80 projects radially outward from the chamber assembly 40 and may be bent downwardly so that the open free end thereof extends into the outer oil collection chamber 60. Likewise the water overflow tube 81 projects radially outward from the chamber assembly 40 and may be bent downwardly so that the open and free end thereof extends into the inner water collection chamber 61. These overflow tubes 80, 81 may be further supported by radial supports 82 which emanate from the hub 50 of the chamber assembly 40.

Since the upper and lower legs 70, 71 of the U-tube sets and the overflow tubes 80 and 81 are all connected to the chamber assembly 40, it should be obvious that rotation of the chamber assembly 40 by the motor or power device 57 will cause rotation of these components as well as the other components attached thereto, e.g. tubular return sections 72, tubular bends 73, valves 74, solenoids 75, etc. about a central vertical axis, i.e. the axis of the shaft 51.

Figure 3:
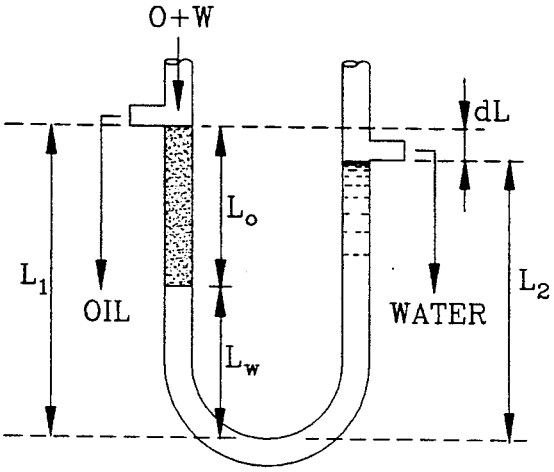
FIGS. 3–5 are schematic representations of U-tube arrangements for explaining the principle of operation of the separating apparatus of the present invention.

To understand the operation of the separating apparatus shown in FIGS. 1 and 2, certain hydrostatic and fluid dynamic principles need to be understood. Referring first to FIG. 3, there is illustrated two liquid columns of a U-tube in hydrostatic equilibrium. The length $L_1$ of the left column is slightly greater than the length $L_2$ of the right column. The difference between the length $L_1$ and $L_2$, i.e. $L_1-L_2$, may be referred to as dL. It is assumed that the left hand column contains water (density=1.0) and oil at a typical density of 0.75 to 0.85. The length of the oil column is $L_o$ and the length of the water is $L_w$. The right hand column (length $L_2$) is filled with water. At hydrostatic equilibrium, the following applies:

$$L_o \times q_o \times g + L_w \times q_w \times g = L_2 \times q_w \times g$$

where $q_o$=density of oil (typically 0.75 to 0.85)

$q_w$=density of water (1.0)

g=acceleration due to gravity

Accordingly, $$L_w = \frac{L_2 \times q_w - L_1 \times q_o}{dq}$$

where $dq = q_w - q_o$

If $L_w=0$, i.e., when $L_1$ is all oil:

$$\frac{L_2}{L_1} = \frac{q_o}{q_w}$$

This shows that the ratio of the lengths of the U-tube's legs determines the maximum ratio of liquid densities that can be separated. For example, if $L_1$ is 16 inches and $L_2$ is 15 inches, then $L_2$ over $L_1$=0.9375, showing that with such tube lengths oil with a density of 0.9375 or less can be separated from water of density 1.0. Thus, if oil and water flow into the upper end of the left hand column, as illustrated in FIG. 3, so that the level of both the left and right hand columns increase, water will flow out of the right hand column and oil will flow out of the left hand column.

Figure 4:
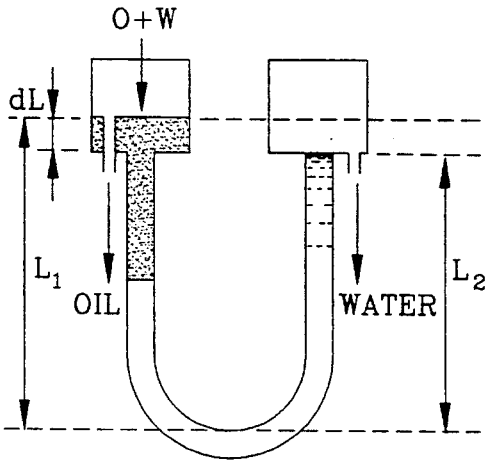

FIG. 4 illustrates the same hydrostatic balance as in FIG. 3. The schematic of FIG. 4 simply illustrates a version in which an oil chamber is provided at the upper end of the left hand column and a water chamber provided at the upper end of the right hand column. However it will be noted that an overflow tube provided with the water chamber opens directly at the bottom of the water chamber and an overflow tube for the oil chamber is extended slightly up into the oil chamber so that the level of oil in the oil chamber is slightly higher than the level of water in the water chamber. As illustrated, the difference in these heights is the same as the difference in the height of the liquid columns of FIG. 3, i.e. dL.

Figure 5:
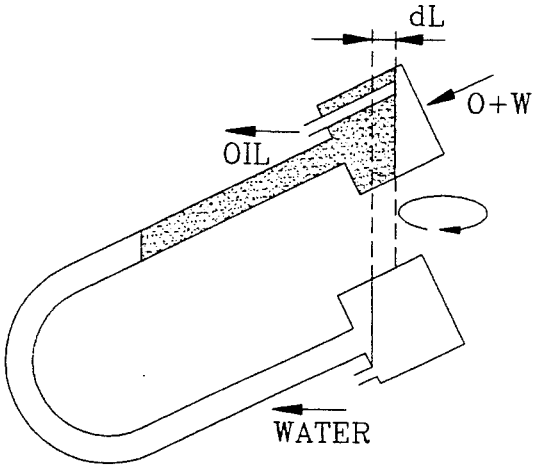

It is noted that in either one of the situations illustrated in FIGS. 3 and 4, the earth's acceleration of gravity g or any gravity for that matter, does not affect the hydrostatics. The effectiveness of separation of one liquid dispersed in another is determined by the difference of two opposing forces, weight and buoyancy, which is expressed by dqg. The higher g at a given dq, the larger the separated force. Consider, for instance, the net force acting on one ml of water submerged in a light oil, say kerosene: dq=0.25 gms/ml. Increased gravity from 1 g (the earth's acceleration of gravity) to approximately 1800 g's (artificial gravity which might be created by rapid rotation of a U-tube about a central axis) results in an apparent change of weight from 0.25 gram force to 450 gram force. FIG. 5 illustrates the principle of increased enhanced gravity by rotation as might occur with an inclined U-tube, such as shown in FIG. 5, rotating about a central axis to the right thereof.

Figure 6:
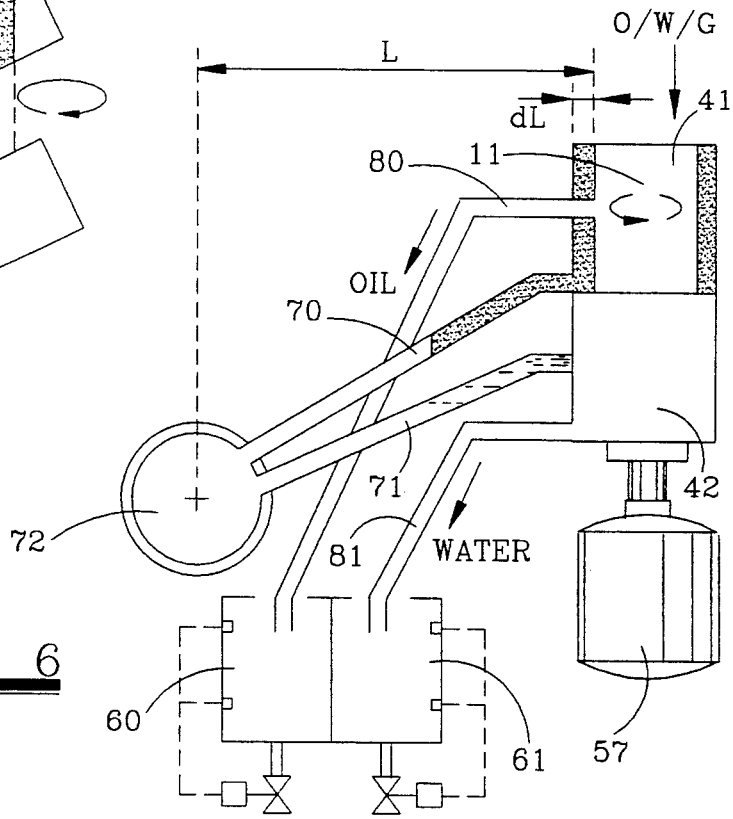
FIG. 6 is a schematic diagram for explaining the operation of the gas, oil and water separating apparatus of the present invention in the preferred embodiment of FIGS. 1 and 2.

The same principle is illustrated in the schematic of FIG. 6 in which the numbers correspond with the embodiment of the invention shown in FIGS. 1 and 2. Oil and water are introduced into the upper chamber 41, chambers 41 and 42 being rotated by the motor 57, e.g at 2,000 rpm. Assuming the separator of FIGS. 1 and 2 is six feet in diameter, gravity generated due to rotation in the middle of the U-tubes is about 2000 g. In the collection chambers at ten inch diameter, the centrifugal gravity is about 450 g. These numbers are high enough to ensure effective separation of oil and water. As this occurs, any water in the mixture flows down the upper leg 70 through return section 72 and the lower leg 71 into the lower chamber 42. The water exits through overflow tube 81 into the water collection chamber 61. Any oil in the mixture has a tendency to rise or flow upwardly through the upper end of the tube 70 accumulating around the periphery of the upper chamber 41 until the oil spills over into the entrance of oil overflow tube 80. The oil then exits into the oil collection chamber 60. The same action occurs in the operation of the preferred embodiment of the invention of FIGS. 1 and 2 as hereafter described.

With the chamber assembly 40 rotating, oil, water, gas and sediment from one or more producing wells flows through the valve 16, check valve 15 and the inlet tube 11 into the chamber assembly 40. Any gases in the effluent exit through the annular spaces around the inlet tube 11 and the opening 47 in the upper portion of the upper chamber 41. These gases are confined in the hermetically sealed housing 1 and will exit through the gas outlet 18 to some place of use.

The water and oil which flows into the upper chamber 41 is directed by the flow direction device 44 radially through the annular space therebelow into the upper chamber 41. As the oil and water enter the rotating chamber 41 it begins to flow through the upper legs 70 of the U-tube sets. However, due to gravity and the enhanced gravitational effect from centrifugal forces, water continues down the upper leg 70, around the return section 72 and up the lower leg 71 into the lower chamber 42. As water accumulates in the lower chamber 42 it overflows through the overflow tube 81 into the water collection chamber 61.

In contrast, the oil in the oil and water mixture separates from the water and tends to rise in the upper leg 70 of the U-tube sets, accumulating in the upper chamber 41. As the oil accumulates, it eventually creates enough volume to flow over into the oil overflow tube 80 which extends slightly (dL) into the upper chamber 41. The oil then flows out the oil overflow tube 80 into the oil collection chamber 60. When oil and water accumulate in the collection chambers 60 and 61, the solenoid operating valves 30 and 33 open to allow the oil and water to drain or be transferred to other locations. If the level in these collection chambers 60 and 61 fall below a certain level, the liquid level sensors 35 and 36 cause the valves 30 and 33 to close.

Due to the centrifugal forces involved, there is a tendency for any sediment in the effluent to accumulate in the tubular return sections 72. From time to time, the sediment valves 74 located in the bends 73 are opened by the solenoid operator 75 to allow water and sediment to be flushed from the system. As this is done, it may be necessary to introduce additional water into the system by opening the valve 17, allowing water from a water supply to flow through the check valve 18 and tee 13 and inlet tube 11 into the chamber assembly. The idea is to have more water flowing in than out. In so doing, the U-tubes remain liquid filled and some excess water has to be expelled through the water overflow tubes. Consequently, the U-tubes that are partially oil filled do not lose their charge and no oil is expelled in the flush. Sediment and water are collected in the lower portion of the housing 1 where they can be drained through outlet 27 for disposal.

It is important to again note that the upper and lower legs 70, 71 of the U-tube assemblies are slanted or inclined downwardly. This arrangement is necessary to keep these legs 70, 71 filled with liquid even when rotation of the separator is stopped. The oil will stay on top of the water in the upper legs 70 and will not drain into the lower legs or the water collection chamber 61. Obviously, this would not be the case if the legs 70, 71 were horizontal.

In summary, the separating apparatus of the present invention provides an enclosed housing in which is centrally disposed a rotatable chamber assembly for rotation about a central vertical axis. The chamber assembly includes upper and lower cylindrical chambers, the upper chamber being in fluid communication with the incoming fluid stream. Both the upper and lower chambers have outlet ports in the outer walls thereof and overflow tubes connected to these outlet ports. The overflow tube for the upper chamber extends slightly into the upper chamber. A plurality of U-tube assemblies extend radially outward from the chamber assembly providing a plurality of U-tube paths, upper legs of which extend radially outward and incline downwardly from the upper chamber and lower legs of which extend radially outward and incline downwardly from the lower chamber. The radially outer ends of the upper and lower legs communicate through tubular return sections. A power device rotates the upper and lower chambers and the U-tube assemblies at a predetermined speed so that as fluid enters the first chamber it is subjected to centrifugal forces which in combination with gravitational forces causes oil and water therein to separate. The water passes through the U-tube paths into the lower chamber for exit through the lower chamber overflow tube, oil accumulating in the upper legs of the U-tube paths and the upper chamber for exit through the upper chamber overflow tube. Any gases in the fluid stream exit through an opening in the top of the upper chamber. The separation is extremely effective and efficient.

A single embodiment of the invention has been described herein which is primarily designed for separating gas, oil and water from the effluent of one or more producing hydrocarbon wells. It can be easily understood that the invention could be adapted for other uses. For example, oil and water skimmed from the surface of a body of oil polluted water could be introduced into the separating apparatus of the present invention, to separate the oil and water, the oil being collected for removal and the water possibly returned to the body of water from which the oil and water mixture was taken. In fact, many other uses and variations of the invention can be made without departing from the spirit thereof. Accordingly, it is intended that the scope of the invention be limited only by the claims which follow.

I claim:

1. Apparatus for separating oil and water from a stream of fluid whose components include oil and water, said apparatus comprising:

stationary housing means having an inlet through which said stream of fluid may enter and oil and water outlets through which oil and water, respectively, may exit from said housing means;

rotatable chamber means centrally disposed in said housing for rotation about a vertical axis, said chamber means including an upper chamber and a lower chamber, said upper chamber being in fluid communication with said housing means inlet to receive said stream of fluid therefrom, each of said chambers being provided in the outer walls thereof with an outlet port;

tube means comprising at least one upper tube section extending radially outward and inclined downwardly from said upper chamber, at least one lower tube section extending radially outward and inclined downwardly from said lower chamber and a connecting tube section connecting the radially outward ends of said upper and lower tube sections; and power means connected to said chamber means to rotate said chamber means at a predetermined speed in which said stream of fluid entering said first chamber is subjected to centrifugal forces which in combination with gravitational forces cause oil and water in said stream to separate, said water passing through said upper tube section, said connecting tube section and said lower tube section into said lower chamber for exit through said lower chamber outlet port, said oil accumulating in said upper tube section and said upper chamber for exit through said upper chamber outlet port.

2. Separating apparatus as set forth in claim 1 including an oil collection chamber and a water collection chamber carried in said housing, said upper chamber outlet port being connected to one end of an oil overflow tube the opened and lower other end of which discharges into said oil collection chamber, said lower chamber outlet port being connected to one end of a water overflow tube the opened and lower other end of which discharges into said water collection chamber.

3. Separating apparatus as set forth in claim 2 including flow direction means carried by said chamber means for directing said stream of fluid from said housing inlet toward the bottom of said upper chamber before exiting through said upper tube section and said upper chamber outlet port.

4. Separating apparatus as set forth in claim 2 in which said oil outlet is disposed near the bottom of said oil collection chamber and said water outlet is disposed near the bottom of said water collection chamber.

5. Separating apparatus as set forth in claim 4 including an oil control valve connected to said oil outlet and a water control valve connected to said water outlet, each of said control valves being connected to level controls for opening and closing said valves in response to the level of oil and water in said oil and water collection chambers, respectively.

6. Separating apparatus as set forth in claim 4 in which said oil and water collection chambers comprise an inner annular water collection chamber and an outer annular oil collection chamber, said lower end of said oil overflow tube extending into said outer annular oil collection chamber and said lower end of said water overflow tube extending into said inner annular water collection chamber, said lower ends of said oil and water overflow tubes rotating in a circular path through said outer and inner annular collection chamber, respectively, upon rotation of said rotatable chamber means.

7. Separating apparatus as set forth in claim 1 in which said tube means comprises a plurality of said upper tube sections and said lower tube sections uniformly and radially extending from said chamber means and a plurality of said tubular connecting sections connecting said outer ends of said upper and lower tube sections, said tubular connecting sections being generally disposed in a segmented circular fashion about said vertical axis, said upper and lower tube sections and said connecting tube sections all rotating about said vertical axis, upon rotation of said chamber means.

8. Separating apparatus as set forth in claim 7 in which drain valves are provided between successive ones of said connecting tube sections which, when opened, permit flushing of sediment from said connecting tube sections.

9. Separating apparatus as set forth in claim 1 in which said upper cylindrical chamber is opened at the top thereof, any gases included in said stream of fluid being separated from oil and water therein by passing through the open top of said upper chamber into said housing and exiting through a gas outlet provided therein.

10. Apparatus for separating gas, oil and water components from a stream of fluid which includes at least two of said components, said apparatus comprising:

an enclosed housing having an upper inlet through which said stream of fluid may enter and gas, oil and water outlets through which separated gas, oil and water, respectively, may exit;

a rotatable chamber assembly centrally disposed in said housing for rotation about a central vertical axis, said assembly comprising upper and lower cylindrical chambers, said upper chamber being in fluid communication with said fluid stream and having an outlet port in the outer walls thereof, said lower chamber having an outlet port in the outer walls thereof;

a plurality of U-tube means extending radially outward from said chamber assembly providing a plurality of U-tube paths upper legs of which extend radially outward and inclined downwardly from said upper chamber, lower legs of which extend radially outward and inclined downwardly from said lower chamber, the radially outer ends of said upper and lower legs communicating through tubular return sections; and power means connected to said chamber assembly to rotate said upper and lower chambers and said U-tube means at a predetermined speed about said central vertical axis, said fluid stream entering said first chamber and being subjected to centrifugal forces which in combination with gravitational forces causes gas, oil and water therein to separate, said water passing through said U-tube paths into said lower chamber for exit through said lower chamber outlet, said oil accumulating in said upper legs of said U-tube paths and said upper chamber for exit through said upper chamber outlet, any gases in said fluid stream exiting through an opening in the top of said upper chamber for containment in said housing and exit through said gas outlet.

11. Separating apparatus as set forth in claim 10 including outer and inner concentrically disposed collection chamber carried into said housing for collecting oil and water, respectively, discharged from said upper and lower chamber outlets, respectively, oil collected in said outer collection chamber being removable from said housing through said oil outlet and water collected in said inner collection chamber being removable from said housing through said water outlet.

12. Separating apparatus as set forth in claim 11 including an oil overflow tube connected to said upper chamber outlet port and the free end of which extends into said outer collection chamber and a water overflow tube connected to said lower chamber outlet port and the free end of which extends into said inner collection chamber.

13. Separating apparatus as set forth in claim 12 in which said tubular return sections of said U-tube means are disposed at regular angular intervals around the interior of said housing.

14. Separating apparatus as set forth in claim 13 in which said tubular return sections also communicate with each other in a generally segmented circular path.

15. Separating apparatus as set forth in claim 13 in which said tubular return sections are provided with drain valves which, when opened, allows water and sediment in said return sections to be discharged therefrom for collection in a portion of said housing.

16. Separating apparatus as set forth in claim 15 including a supply of water connected to said upper inlet of said housing by which additional water may be introduced into said separating apparatus to aid in removal of sediment from said return sections when said drain valves are opened.

17. Separating apparatus as set forth in claim 10 in which said U-tube means comprises a plurality of sets of legs and return sections, each of said sets including two upper legs, one lower leg and a corresponding tubular return section.

18. Separating apparatus as set forth in claim 17 in which said upper legs are connected to said upper chamber at an elevation slightly below the elevation at which oil must rise prior to exit from said upper chamber outlet port.

19. Separating apparatus as set forth in claim 10 in which said upper chamber is provided with a frustoconical fluid direction device, the lower and larger diameter end of which is slightly elevated above the bottom of said chamber to provide a radial path through which oil and water must pass prior to exit from said upper chamber.

20. Separating apparatus as set forth in claim 19 in which said housing inlet is provided with a downwardly directed tubular member which extends through the smaller diameter of said frusto-conical fluid direction device for directing said fluid stream therein, the outside of said tubular member being of less diameter than the smaller diameter of said fluid direction device leaving an annular path through which any gases in said fluid stream may pass for exit through said gas outlet.

* * * * *